US007695110B2

(12) United States Patent
Ueno et al.

(10) Patent No.: US 7,695,110 B2
(45) Date of Patent: Apr. 13, 2010

(54) LIQUID EJECTION APPARATUS

(75) Inventors: Nobuhiro Ueno, Takatsuki (JP); Masakazu Date, Hachioji (JP)

(73) Assignee: Konica Minolta Holdings, Inc. (JP)

( * ) Notice: Subject to any disclaimer, the term of this patent is extended or adjusted under 35 U.S.C. 154(b) by 462 days.

(21) Appl. No.: 11/793,381

(22) PCT Filed: Dec. 16, 2005

(86) PCT No.: PCT/JP2005/023116

§ 371 (c)(1),
(2), (4) Date: Jun. 18, 2007

(87) PCT Pub. No.: WO2006/068036

PCT Pub. Date: Jun. 29, 2006

(65) Prior Publication Data

US 2008/0122887 A1 May 29, 2008

(30) Foreign Application Priority Data

Dec. 22, 2004 (JP) ..... 2004-371309

(51) Int. Cl.
*B41J 2/06* (2006.01)

(52) U.S. Cl. ..... 347/55; 347/68

(58) Field of Classification Search ..... 347/44, 347/47, 54, 55, 68, 70–72
See application file for complete search history.

(56) References Cited

U.S. PATENT DOCUMENTS 5,477,249 A 12/1995 Hotomi

FOREIGN PATENT DOCUMENTS

| | | | |
|---|---|---|---|
| JP | 05104725 | | 4/1993 |
| JP | 05278212 | | 10/1993 |
| JP | 06134992 | | 5/1994 |
| JP | 2003053977 | | 2/2003 |
| JP | 2006192614 A | * | 7/2006 |
| WO | 03070381 A1 | | 8/2003 |

OTHER PUBLICATIONS

International Search Report for International Application No. PCT/JP2005/023116 dated Feb. 21, 2006.

* cited by examiner

*Primary Examiner*—Juanita D Stephens
(74) *Attorney, Agent, or Firm*—Cantor Colburn LLP

(57) ABSTRACT

In a liquid ejection apparatus, having: a liquid ejection head having, a nozzle plate having a nozzle to eject liquid, a cavity to reserve liquid ejected form a ejection hole of the nozzle, a pressure generating device to form a meniscus of the liquid, and a ejecting voltage applying device to apply a ejection voltage to the liquid in the nozzle; a operation control device to control application a drive voltage to drive the pressure generating device and application of the ejection voltage by the ejection voltage applying device; and a counter electrode opposite to the liquid ejection head; wherein in the liquid ejection device in which the liquid is ejected by a static electric attraction force generated between the liquid in the nozzle to which a voltage is applied by the ejection voltage applying device and the counter electrode, and by a pressure generated in the nozzle, the pressure generating device to form the liquid meniscus forms the meniscus having a height of equal to or more than 1.3 times a radius of the nozzle on the ejection hole of the nozzle.

6 Claims, 9 Drawing Sheets

LIQUID EJECTION APPARATUS

CROSS REFERENCE TO RELATED APPLICATIONS

This is a U.S. national stage of application No. PCT/JP2005/023116, filed on 16 Dec. 2005. Priority under 35 U.S.C. §119(a) and 35 U.S.C. §365(b) is claimed from Japanese Application No. 2004-371309, filed 22 Dec. 2004, the disclosure of which is also incorporated herein by reference.

FIELD OF THE INVENTION

The present invention relates to a liquid ejection head and a liquid ejection apparatus, particularly to an electric field concentration type liquid ejection apparatus having a flat nozzle.

BACKGROUND OF THE INVENTION

In recent years, there has been a growing demand for formation of a fine pattern formation and ejection of a high-viscosity ink due to the progress of high-definition image quality by inkjet method and expansion in the scope of its application in the industrial field. If the conventional inkjet recording method is used to solve this problem, it is necessary to produce a very fine nozzle and to increase a pressure to eject high-viscosity ink. This requires higher drive voltage and increases cost of the head and the apparatus. Thus, no apparatus that can meet practical use had not been realized.

To meet the aforesaid demand, there is known a technology to eject high-viscosity as well as low-viscosity liquid droplets through a very fine nozzle, so-called electrostatic suction type liquid particle ejection technique wherein a liquid in the nozzle is electrostatically charged and is ejected by the electrostatic suction force received from the electric field formed between the nozzle and various types of substrates as objects for receiving the liquid droplets (Patent Document 1).

Also a development is being advanced to produce an liquid droplet ejection apparatus based on a so-called electric field assist method combining the aforementioned liquid particle ejection technique and the technology of ejecting liquid droplets by a pressure generating device through deformation of the piezoelectric element or generation of air bubbles inside the liquid (Patent Document 2 through 5). The electric field assist method is that, a liquid meniscus is risen on the ejection hole of the nozzle using a meniscus forming device which is a pressure generation device such as a piezoelectric element and the electrostatic suction force thus an electrostatic suction force with respect to the meniscus is increased, and the meniscus is formed into a liquid droplet while overcoming a liquid surface tension, with the result that the liquid droplet is ejected.

[Patent Document 1] International Publication No. 03/070381 (Booklet)

[Patent Document 2] Unexamined Japanese Patent Application Publication No. H5-104725

[Patent Document 3] Unexamined Japanese Patent Application Publication No. H5-278212

[Patent Document 4] Unexamined Japanese Patent Application Publication No. H6-134992

[Patent Document 5] Unexamined Japanese Patent Application Publication No. 2003-53977

DISCLOSURE OF INVENTION

Problems to be Solved by the Invention

The aforementioned liquid ejection apparatus based on the electric field assist method provides better ejection efficiency than the inkjet recording method using the conventional piezoelectric method or thermal method. However, since the electrostatic suction force by the electric field is not maximally utilized, meniscus formation or liquid droplet ejection cannot be carried out efficiently. Just like the case of the conventional inkjet recording method, there was a problem that the drive voltage must be increased in order to meet the requirements to form a fine pattern and to ejection high-viscosity ink, and thereby cost of the head and the apparatus increase. Further, if the applied voltage is raised so as to increase the electrostatic suction force, insulation breakdown occurs between the head and the substrate, with the result that the apparatus cannot be driven. Such problems have been left unsolved in the aforementioned technologies.

Further, by the vibration at the time of formation of the meniscus by a pressure generation device, liquid is incorrectly ejected from a nozzle which is not intended to eject the liquid. Alternatively, the liquid ejected from the nozzle becomes ropy (hereinafter referred to as "tailor cone") and the liquid becomes mist to scatter into the air. Unintended fine liquid droplets other than the main liquid droplets, viz., "satellites" are generated. Such problems have been left unsolved.

The object of the present invention is to solve the aforementioned problems and to provide a liquid ejection apparatus which ensures that an ejection error does not occur easily, and the liquid ejected from the nozzle is not sprayed as mist or fragmented to form satellites.

Means for Solving the Problems

To solve the aforementioned problems, the liquid ejection apparatus described in the item 1 includes:

a nozzle plate equipped with a nozzle for ejecting liquid;

a cavity for storing the liquid ejected from the ejection hole of this nozzle;

a liquid ejection head further having a pressure generation device for forming the meniscus of this liquid and an ejection voltage application device for applying an ejection voltage to the liquid in the nozzle;

an operation control device for controlling application of the drive voltage to drive the pressure generation device and application of the ejection voltage by the ejection voltage application device; and a counter electrode placed opposite to the liquid ejection head;

wherein liquid is ejected by the electrostatic suction force generated between the liquid in the nozzle applied by the ejection voltage application device and the aforementioned counter electrode, and the pressure generated inside the nozzle; and wherein a meniscus having a height equal to or greater than 1.3 times the radius of the nozzle is formed in the ejection hole of the nozzle by the pressure generation device for forming the meniscus of liquid.

According to the invention described in item 1, formation of a tailor cone can be avoided by a meniscus having a height equal to or greater than 1.3 times the radius of the nozzle. Further, liquid can be ejected as a single liquid droplet.

The invention of the item 2 is the liquid ejection apparatus described in Structure 1 wherein the internal diameter of the ejection hole of the nozzle is equal to or less than 15 μm.

According to the invention of item 2, efficient concentration of electric field on the meniscus formed is ensured by the ejection hole of the nozzle having an internal diameter equal to or less than 15 μm. Further, efficient concentration of electric field allows a fine liquid to be ejected from a nozzle having a very small diameter, whereby a high-quality image can be produced.

The invention described in item 3 is the liquid ejection apparatus described in item 1 or 2 wherein the aforementioned nozzle is the flat one that does not protrude from the ejection surface.

According to the invention of item 3, generation of a satellite or mist can be avoided even when a flat nozzle is used. It should be noted that the flat nozzle refers to the nozzle wherein the nozzle is not much protruded from the nozzle plate, without the protruded height exceeding 30 μm. There is an advantage that wiping operation can be carried out without catching or breaking a wiper during the nozzle plate surface is being wiped thanks to a small projection of the nozzle.

The invention described in item 4 is the liquid ejection apparatus described in item 3 wherein the volume resistivity of the nozzle plate is equal to or greater than $10^{15}$ Ωm.

According to the invention of item 4, the material having a volume resistivity equal to or greater than $10^{15}$ Ωm is used to manufacture the nozzle plate on which a nozzle is formed. This arrangement ensures effective concentration of the electric field on the meniscus of liquid formed on the ejection hole of the nozzle, even if the electrostatic voltage applied to the liquid inside the nozzle from the electrostatic voltage application device is about 1.5 kV.

The invention described in item 5, the liquid in the liquid ejection apparatus described in item 4 includes a conductive solvent, and the absorption coefficient of the liquid by the nozzle plate is equal to or less than 0.6%.

According to the invention of items 5, when the absorption coefficient of the liquid including the conductive solvent by the nozzle plate is equal to or greater than 0.6%, the conductive solvent is absorbed from the liquid. When the absorption coefficient of the liquid is equal to or less than 0.6%, the conductive solvent cannot be absorbed from the liquid.

Effects of the Invention

According to the invention of item 1, stable ejection of liquid from the nozzle is ensured. Further, this invention ensures that the liquid ejected from the nozzle is not formed in a shape of tailor cone, and mist and satellite are not occurred. At the same time, this invention enables to eject a single main liquid droplet stably, and improves ejection stability and image quality.

According to the invention of item 2, stable ejection of liquid as micro liquid droplet is possible.

According to the invention of item 3, even when a flat nozzle is used, mist and the satellite are not generated from the liquid ejected from the nozzle, thus, stable liquid ejection is realized.

According to the invention of item 4, the material having a volume resistivity equal to or greater than $10^{15}$ Ωm is used to manufacture the nozzle plate on which a nozzle is formed. This arrangement ensures effective concentration of the electric field on the meniscus of liquid formed on the ejection hole of the nozzle, even if the electrostatic voltage applied to the liquid in the nozzle from the electrostatic voltage application device is about 1.5 kV. Thus, the intensity of the electric field on the front end of the meniscus can be adjusted to ensure efficient and stable ejection of the liquid droplet.

According to the invention of item 5, by using a nozzle plate having the absorption coefficient of the liquid by the nozzle plate is equal to or less than 0.6%, it is effectively prevented that the nozzle palate absorbs the conductive solvent from the liquid then the volume resistivity is reduced. As a result, stable ejection of the liquid form the nozzle is impaired. Thereby the effect of the invention of the item 5 is further brought out.

BEST FORM OF EMBODIMENT OF THE PRESENT INVENTION

Figure 1:
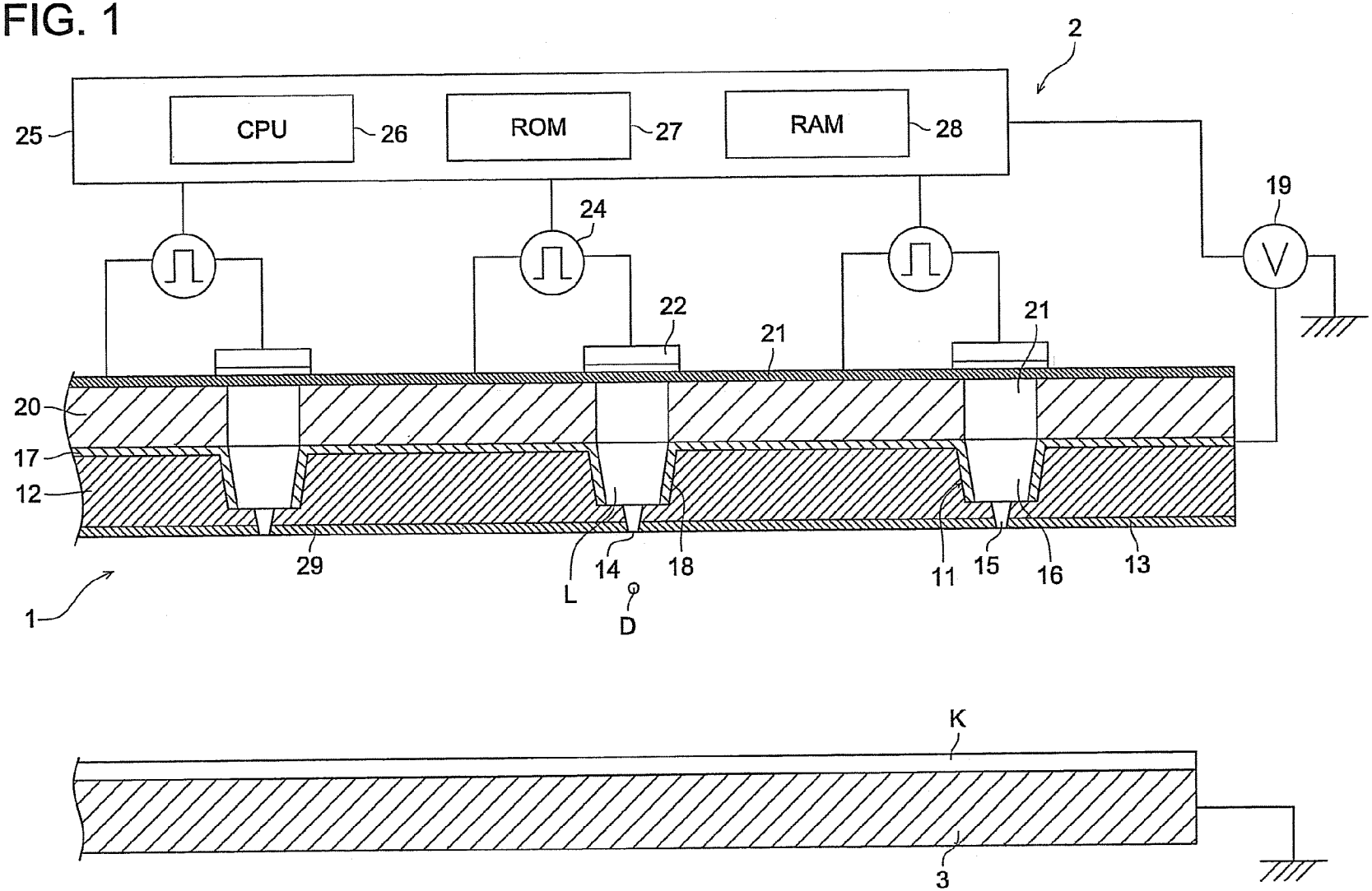
FIG. 1 is a cross-sectional view showing the overall structure of the liquid ejection apparatus related to a present embodiment.

The following describes the embodiments of the liquid ejection apparatus of the present invention with reference to drawings:

FIG. 1 is a cross-sectional view showing the overall structure of the liquid ejection apparatus related to a present embodiment. The liquid ejection head 2 of the present invention can be applied to various types of liquid ejection apparatuses such as so-called serial and line types.

The liquid ejection apparatus 1 of the present embodiment has a liquid ejection head 2 equipped where a nozzle 11 for ejecting liquid droplet D of liquid L such as ink that can be electrostatically charged; and a counter electrode 3 for supporting the a base member K have in a opposing surface on which the liquid droplet D lands, opposite to the nozzle 11 of a liquid ejection head 2.

A resin-made nozzle plate 12 provided with a plurality of nozzles 11 is arranged on the side opposite to the counter electrode 3 of the liquid ejection head 2. The liquid ejection head 2 is configured as a head having a flat ejection surface wherein the nozzle 11 is not protruded from the ejection surface 13 facing the counter electrode 3 of the nozzle plate 12 or the nozzle 11 is protruded only about 30 μm the surface thereof as mentioned above (e.g., FIG. 2 (D) to be shown later).

Each of the nozzles 11 is formed on the nozzle plate 12, and each nozzle 11 is designed in a two-stepped structure in which a small-diameter section 15 has an ejection hole 14 on the ejection surface 13 of the nozzle plate 12, and a large-diameter section 16 has a large-diameter section 16 formed behind the small diameter section. In the present embodiment, the small-diameter section 15 and large-diameter section 16 of the nozzle 11 have a circular cross section and are formed in a tapered structure having a smaller diameter on a counter electrode side. An internal diameter (hereinafter referred to as "nozzle diameter") of the ejection hole 14 of the small-diameter section 15 is 10 μm, and the internal diameter on the aperture side farthest from the small-diameter section 15 of the large-diameter section 16 is 75 μm. If the nozzle diameter is equal to or greater than 15 μm, a higher ejection voltage is required to eject liquid. To avoid this disadvantage, it is preferred for the nozzle diameter not to exceed 15 μm.

Figure 2:
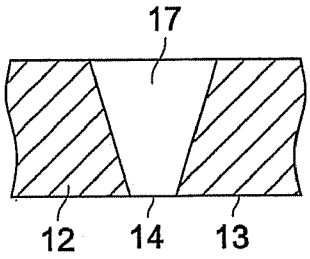
FIG. 2 is a diagram representing variations of nozzles having different cavities.
Figure 2:
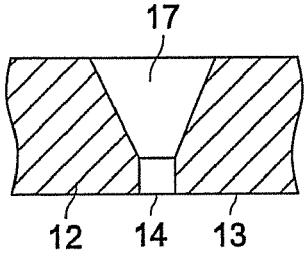
Figure 2:
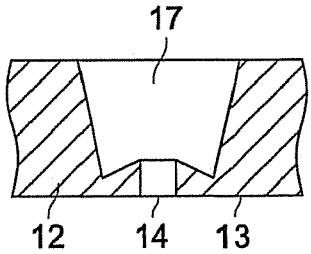
Figure 2:
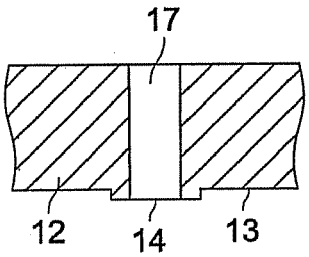
Figure 2:
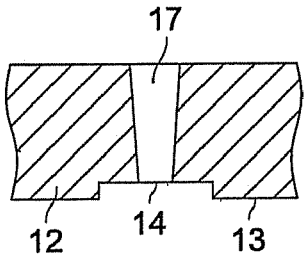
Figure 2:
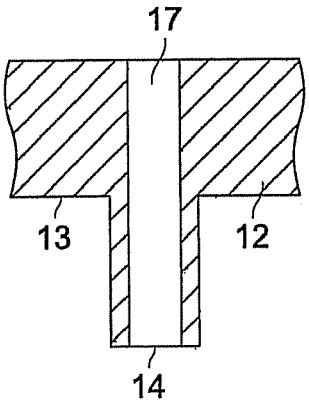
Figure 2:
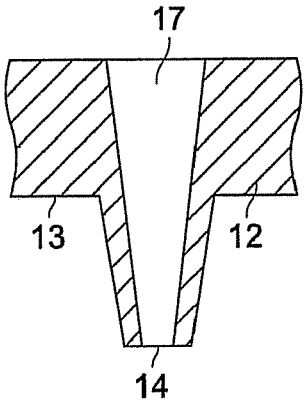

Without being restricted to the aforementioned cases, the shape of the nozzle 11 can be designed in a great variety of shapes, such as the flat nozzle shown in FIGS. 2 (A) through (E). It is also possible to use a protrusion type nozzle wherein the nozzle is protruded from the ejection surface 13, as shown in FIGS. (F) and (G). Further, it is possible to use a polygonal cross section or star-shaped cross section type instead of the circular cross section type as the nozzle 11.

A charging electrode 17 made of a conductive material such as NiP for charging the liquid L in the nozzle 11 is arranged in the form of a layer on the nozzle plate 12 side opposite to the side of the ejection surface 13. In the present embodiment, the charging electrode 17 extends up to the inner peripheral surface 18 of the large-diameter section 16 of the nozzle 11 so as to contact the liquid L in the nozzle.

Further, the charging electrode 17 is connected with an electrostatic voltage power supply 19 as an electrostatic voltage application device for applying the electrostatic voltage that produces the electrostatic suction force. A single charging electrode 17 is in contact with liquids L in all the nozzles 11. When the electrostatic voltage is applied to the charging electrode 17 from the electrostatic voltage power supply 19, the liquid L in all the nozzles 11 is electrostatically charged, and the electrostatic suction force is produced between the liquid ejection head 2 and counter electrode 3, especially between the liquid L and substrate K.

A body layer 20 is arranged on the back of the charging electrode 17. Substantially cylindrical spaces having an internal diameter approximately equal to that of the aperture end are formed respectively on the portion facing the aperture end of the large-diameter section 16 of each the aforementioned nozzle 11 of the body layer 20. Each space serves as a cavity 21 for temporary storage of the liquid L to be ejected.

A flexible metallic thin plate and flexible layer 22 made of silicon and others are provided on the rear of the body layer 20. The liquid ejection head 2 is isolated from the external environment by the flexible layer 22.

A flow path (not illustrated) for supplying liquid L to the cavity 21 is arranged on an interface with the flexible layer 22 of the body layer 20. To put it more specifically, a common flow path and a flow path connecting the common flow path and the cavity 21 are formed by etching the silicon plate as the body layer 20. The common flow path is connected with the supply tube (not illustrated) for supplying the liquid L from an external liquid tank (not illustrated). A predetermined supply pressure is applied to the liquid L of the flow path, cavity 21 and nozzle 11 by a supply pump (not illustrated) provided on the supply tube or by the differential pressure due to the layout position of the liquid tank.

A piezoelectric element 23 as a piezoelectric element actuator representing a pressure generation device is arranged on the portion corresponding to each cavity 21 on the outer surface of the flexible layer 22. The piezoelectric element 23 is connected with a drive voltage power supply 24 for applying a drive voltage to the element and to deform it. The piezoelectric element 23 is deformed by the drive voltage applied by the drive voltage power supply 24, and a pressure is applied to the liquid L in the nozzle so that the meniscus of the liquid L is formed on the ejection hole 14 of the nozzle 11. Meanwhile, other than the piezoelectric element actuator of present invention, the pressure generation device can be substituted by an electrostatic actuator, thermal method and so forth.

In this case, the height of the meniscus formed by the pressure generation device is preferably equal to or greater than 1.3 times the nozzle radius or more and equal or less than 6 times.

Figure 3:
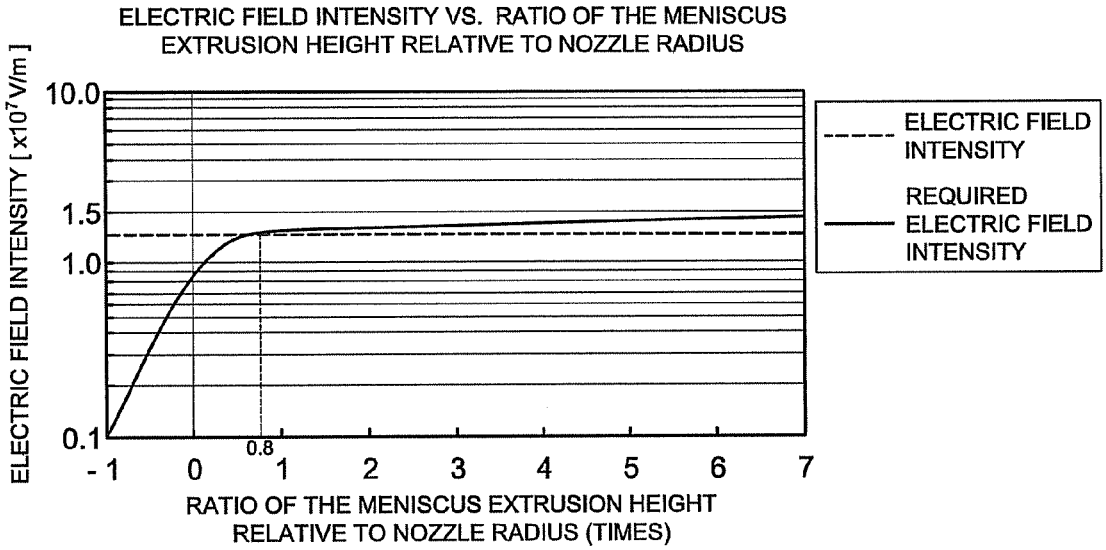
FIG. 3 is a chart representing the relationship between a ratio of the meniscus height relative to the nozzle radius and the intensity of the electric field for meniscus ejection.

FIG. 3 is a chart representing the relationship between the ratio of the meniscus height relative to the nozzle radius, and the intensity of electric field for meniscus ejection. The intensity of electric field [V/m] is plotted along the vertical axis, while the ratio of the meniscus height [μm] relative to the nozzle radius [μm] is plotted along the horizontal axis. This test was conducted under the same conditions as those for the test to be described later. As a chart of FIG. 3 clarifies, the intensity of electric field for meniscus ejection reaches $1.5\times 10^7$ V/m when the ratio of the meniscus height relative to the nozzle radius becomes 0.8 times or more.

However, even when the meniscus height is equal to or less than 1.3 times the nozzle radius, liquid can be ejected, however the electrostatic suction force must be much increased in that case. This means consumption of a great amount of energy, and hence running cost increases. Further, if the meniscus height is equal to or less than 1.3 times the nozzle radius, there is a problem that since a difference between the electric fields generated when the meniscus is extruded and not extruded is small, other nozzles react with the minute fluctuation of the meniscus resulting from vibration at the time of formation of the meniscus caused by the pressure generation device thus liquid is ejected incorrectly from the nozzles through which ejection is not intended.

In case the meniscus height is equal to or less than 1.3 times the nozzle radius, the ejected liquid is formed in a shape of a tailor cone. The liquid in the shape of a tailor cone flies in a shape of a filament at the beginning. As it flies, the liquid is separated into a plurality of minute liquid droplets. Liquid droplets repel each other to become a mist or satellite. Thus, if the liquid is formed in a shape of the tailor cone and the distance between the nozzle and the substrate K on which the liquid ejected from this nozzle lands is equal to or greater than a predetermined value, a mist or satellite is generated from the aforementioned liquid in the shape the tailor cone.

In case the meniscus height is equal to or greater than 1.3 times, the liquid ejected from the nozzle is formed into a single main liquid and flies thereafter the droplet lands the target destination. This does not allow a mist or satellite to be generated.

The meniscus height is made equal to or less than six times the nozzle radius. This is because, if it is equal to or greater than 6 times, the ejection electric power required to form a meniscus is increased, and this increases the running cost. Further, if it is equal to or greater than 6 times, ejection is carried out substantially only by the pressure without static electricity. Thus, use of static electricity still can maintain the advantage of maintaining the flying speed of the liquid droplet and stabilizing a direction of flying however, the effects of forming a minute liquid droplet and reducing the load on the pressure generation device are sacrificed.

The aforementioned electrostatic voltage power supply 19 for applying electrostatic voltage to the drive voltage power supply 24 and charging electrode 17 is connected with the operation control device 25 and is to be controlled by operation control device 25.

In the present embodiment, the operation control device 25 is made up of a computer connected with a CPU 26, ROM 27 and RAM 28 via a bus (not illustrated). In response to the power supply control program stored in the ROM 27, the CPU 26 drives the electrostatic voltage power supply 19 and drive voltage power supply 24 so that liquid L is ejected from the ejection hole 14 of the nozzle 11.

In the present embodiment, a liquid repellent layer 29 for controlling bleeding of liquid L from the ejection hole 14 is provided on whole the ejection surface 13 of the nozzle plate 12 of the liquid ejection head 2 except the ejection hole 14. For example, if the liquid L is aqueous, a water repellent material is used for the liquid repellent layer 29 and if the liquid L is oily, an oil-repellent material is used for the liquid repellent layer 29. Generally, a fluorine resin such as FEP (ethylene tetrafluoride-propylene sexafluoride), PTFE (polytetrafluoroethylene), fluoro siloxane, fluoro alkylsilane or amorphous perfluoro resin is often used. The method of coating or vapor deposition is used to form a film on the ejection surface 13. It should be noted that the liquid repellent layer 29 can be formed directly on the ejection surface 13 of the nozzle plate 12, or can be formed through an intermediate layer in order to improve the close contact with the liquid repellent layer 29.

Below the liquid ejection head 2, the tabular counter electrode 3 for supporting the substrate K is arranged parallel to and separated from the ejection surface 13 of the liquid ejection head 2 with a predetermined distance. The separating distance between the counter electrode 3 and liquid ejection head 2 is adequately set within a range of about 0.1 through 3.0 mm.

In the present embodiment, the counter electrode 3 is grounded, and the voltage is always maintained at the ground voltage. Thus, when electrostatic voltage is applied to the charging electrode 17 from the aforementioned electrostatic voltage power supply 19, electric field is produced between the liquid L of the ejection hole 14 of the nozzle 11 and the surface opposite the liquid ejection head 2 of the counter electrode 3. Further, when the electrostatically charged liquid droplet D has reached the substrate K, the counter electrode 3 allows the electrostatic charge to be dissipated into the ground.

The counter electrode 3 or liquid ejection head 2 is provided with a positioning device (not illustrated) for positioning the liquid ejection head 2 and substrate K by moving relatively. Because of this arrangement, the liquid droplet D ejected from each nozzle 11 of the liquid ejection head 2 can be ejected to a desired position on the surface of the substrate K.

The liquid L ejected by the liquid ejection apparatus 1 as an inorganic liquid, water, $COCl_2$, HBr, $HNO_3$, $H_3PO_4$, $H_2SO_4$, $SOCl_2$, $SO_2Cl_2$, are $FSO_3H$ exemplified.

Also, as the organic liquid alcohols such as methanol, n-propanol, isopropanol, n-butanol, 2-methyl-1-propanol, tert-butanol, 4-methyl-2-pentanol, benzyl alcohol, α-terpineol, ethylene glycol, glycerine, diethylene glycol and triethylene glycol;

phenols such as phenol, o-cresol, m-cresol and p-cresol;

Ethers such as dioxane, furfural, ethylene glycol dimethyl ether, methyl cellosolve, ethyl cellosolve, butyl cellosolve, ethyl carbitol, butylcarbitol, butylcarbitol acetate and epichlorohydrin;

ketones such as acetone, methylethyl ketone, 2-methyl-4-pentanone and acetophenone;

aliphatic acids such as formic acid, acetic acid, dichloro acetic acid, and trichloro acetic acid;

esters such as methyl formate, ethyl formate, methyl acetate, ethyl acetate, acetic acid-n-butyl, isobutyl acetate, acetic acid-3-methoxybutyl, acetic acid-n-pentyl, ethyl m propionate, ethyl lactate, methyl benzoate, diethyl malonate, dimethylphthalate, diethyl phthalate, diethyl carbonate, ethylene carbonate, propylene carbonate, cellosolve acetate, butylcarbitol acetate, ethyl acetoacetate and methyl cyanacetate and ethyl cyanoacetate;

nitrogen-containing compounds such as nitromethane, nitrobenzene, acetonitrile, propionitrile, succinonitrile, valeronitrile, benzonitrile, ethylamine, diethylamine, ethylene diamine, aniline, N-methylaniline, N,N-dimethylaniline, o-toluidine, p-toluidine, piperidine, pyridine, α-picoline, 2,6-lutidine, quinoline, propylene diamine, folmamide, N-methylformamide, N,N-dimethylformamide, N,N-diethyl formamode, acetoamide, N-methylacetoamide, N-methylpropionic amide, N,N,N',N'-tetramethyl urea and N-methylpyrrolidone;

sulfur-containing compounds such as dimethylsulfoxide and sulfolane;

hydrocarbons such as benzene, p-cymene, naphthalene, cyclohexyl benzene and cyclohexene;

halogenated hydrocarbons such as 1,1-dichloroethane, 1,2-dichloroethane, 1,1,1-trichloroethane, 1,1,1,2-tetrachloroethane, 1,1,2,2-tetrachloroethane, pentachloroethane, 1,2-dichloroethylene (cis-), tetrachloroethylene, 2-chlorobutane, 1-chloro-2-methylpropane, 2-chloro-2-methylpropane, bromomethane, tribromemethane and 1-bromopropane are exemplified. Also, two or more of the aforementioned liquids can be mixed.

Further, in case the conductive paste that contains a lot of materials of high electric conductivity (silver pigment or the like) is used as liquid L for ejection there is no restriction of a target substance to be dissolved or dispersed in the aforementioned liquid L, except such material having a large-sized particles that may cause clogging in the nozzle.

A conventionally known material can be used as the fluorophore such as PDP, CRT and FED without restriction. For example, as a red fluorophore, such a substance as (Y, Gd) $BO_3$:Eu, $YO_3$:Eu can be used, as a green fluorophore such a substance as $Zn_2SO_4$:Mn, $BaAl_{12}O_{19}$:Mn, (Ba, Sr, Mg) O.α-$Al_2O_3$: Mn can be used, and as a blue fluorophore, such a substance as $BaMgAl_{14}O_{23}$:Eu, $BaMgAl_{10}O_{17}$:Eu can be used.

Various types of binders are preferably added to ensure rigid bondage of the aforementioned target substance onto the recording medium. The binders to be used are exemplified by celluloses and the derivative thereof such as ethyl cellulose methylcellulose, nitrocellulose, cellulose acetate and hydroxyethyl cellulose; alkyd resin; (meth) acryl resin and its metal salt such as polymethacrylic acid, polymethylmethacrylate, 2-ethylhexyl methacrylate-methacrylic acid copolymer, and laurylmethacrylat-2-hydroxyethylmethacrylate copolymer; poly((meth)acrylamide resin such as poly-N-isopropylacrylamide, poly-N and N-dimethylacrylamide; styrene based resin such as polystyrene, acrylonitrile-styrene copolymer, styrene-maleic acid copolymer and styrene-isoprene copolymer; styrene-acryl resin such as styrene-n-butylmethacrylate copolymer; various types of saturated and unsaturated polyester resin; polyolefin based resin such as polypropylene; halogenated polymer such as polyvinyl chloride and polyvinylidene chloride; vinyl based resin such as polyvinyl acetate, polyvinyl chloride and vinyl acetate copolymer; polycarbonate resin; epoxy based resin; polyurethane based resin; polyacetal resin such as polyvinyl formal, polyvinyl butyral and polyvinyl acetal; a polyethylene based resin such as ethylene-vinyl acetate copolymer and ethylene ethylacrylate copolymer resin; amide resin such as benzoguanamine; urea resin; melamine resin; polyvinyl alcohol resin and its anion/cation degeneration; polyvinyl pyrrolidone and its copolymer; alkyleneoxide independent polymer, copolymer and crosslinking substance such as polyethylene oxide and calboxylated polyethylene oxide; polyalkylene glycol such as polyethylene glycol and polypropylene glycol; polyether polyol; SBR and NBR latex; dextrin; sodium alginate; natural or semi-synthetic resin such as gelatine and the derivative thereof, casein, Abelmoschus monihot, gum dragon, Pullulan, gum arabic, locust bean gum, Cyamoposis Gum, pectin, caraginine, glue, albumin, various types of starch, cone starch, konjak (devil's tongue), gloiopeltis, agar and soy bean protein; terpene resin; ketone resin; rosin and rosin ester; polyvinylmethyl ether, polyethyleneimine, polystyrene sulfonic acid, polyvinyl sulfonic acid, and others can be used. These resins can be used as homopolymer also they can be blended in a range where they are compatible with each other.

When the liquid ejection apparatus 1 is used as a patterning means, it can be used typically for display. To put it more specifically, it can be used for form of a plasma display fluorophore, forming of a plasma display rib, formation of a plasma display electrode, forming of a CRT fluorophore, forming of a FED (field ejection display) fluorophore, forming of a FED rib, color filter for liquid crystal display (RGB colored layer and black matrix layer), space for liquid crystal display (pattern, dot pattern and others corresponding to the black matrix).

Meanwhile the rib denotes a general barrier. To take an example from the plasma display, a rib is used to separate plasma areas of different colors. As other usages, it is used for patterning coating such as a micro lens, as a semiconductors, a magnetic substance, ferromagnetic substance, and conducting paste (wire and antenna) for graphic application, ordinary printing, printing on the special medium (e.g., film, fabric and steel plate), printing on the curved surface and printing on various types of printing plates, for processing, applying of cohesive agents and sealing agent based on the present invention and for biotechnology and medical care, pharmaceuticals (where a plurality of a trace quantity of components are mixed) and coating samples for gene diagnosis.

The following describes the principle of ejecting liquid L in the liquid ejection head 2 of the present invention, with reference to the present embodiment:

In the present embodiment, an electrostatic voltage is applied to the charging electrode 17 from the electrostatic voltage power supply 19 so that an electric field is generated between the liquid L of the ejection hole 14 of the nozzle 11 and the surface opposite to the liquid ejection head 2 of the counter electrode 3. Further, a drive voltage is applied to the piezoelectric element 23 from the drive voltage power supply 24, thereby causing deformation to the piezoelectric element 23. Then the pressure occurring to the liquid L thereby permits a meniscus of the liquid L to be formed on the ejection hole 14 of the nozzle 11.

Figure 4:
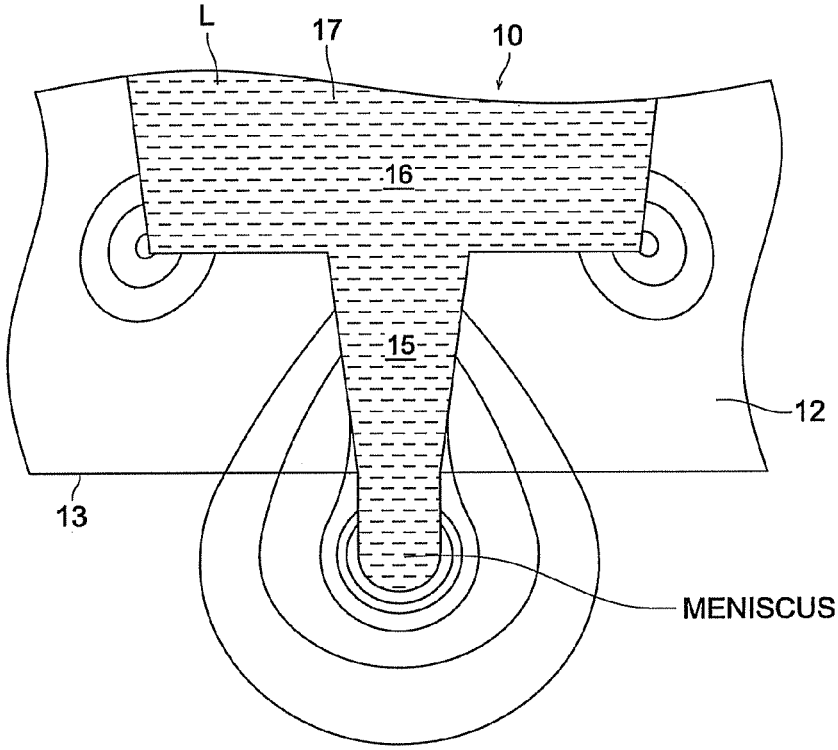
FIG. 4 is a schematic diagram representing the potential distribution near the ejection hole of the nozzle by simulation.

As in the present embodiment, when the nozzle plate 12 has a high degree of insulation, equipotential lines are arranged inside the nozzle plate 12 approximately perpendicular to the ejection surface 13, as indicated by the equipotential line by a simulation in FIG. 4, and a strong electric field is produced towards the liquid L of the small-diameter section 15 of the nozzle 11 and the meniscus portion of the liquid L.

As the dense equipotential lines on the front end of the meniscus in FIG. 4 clarify, a very strong electric field is produced on the front end of the meniscus. Thus, the meniscus is torn off by the static electricity of the electric field, and is separated from the liquid L inside the nozzle to be changed into a liquid droplet D. Further, the liquid droplet D is accelerated by static electricity and is attracted by the substrate K supported by the counter electrode 3 to land the destination. In this case, the liquid droplet D tends to reach closer positions due to the static electricity. This ensures a stable and accurate angle of landing on the substrate K.

In an experimental test where the intensity of electric field between the electrodes is 1.5 kV/mm of a practical value, the nozzle plates 12 was formed using various types of insulators, carried out by the inventors under the conditions below, there were the cases where liquid droplet D was ejected and not ejected. [Test conditions]

Distance between the ejection surface 13 of the nozzle plate 12 and the surface opposite the counter electrode 3: 10 mm Thickness of nozzle plate 12: 125 μm Nozzle diameter: 10 μm Electrostatic voltage: 1.5 kV Drive voltage: 20V In this experiment carried out by and an actual device, the intensity of the electric field at front end of the meniscus was investigated in all cases where the liquid droplet D is ejected from the nozzle 11 in stable condition. In practice, since it is difficult to measure the electric field intensity directly, the intensity of the electric field is calculated in a current distribution diagnosis mode of an electric field simulation software "PHOTO-VOLT"™ (Product of Photon Inc.) This test has revealed that the intensity of electric field on the front end of the meniscus was equal to or greater than $1.5\times10^{7}$ V/m (15 kV/mm) in all cases.

Figure 5:
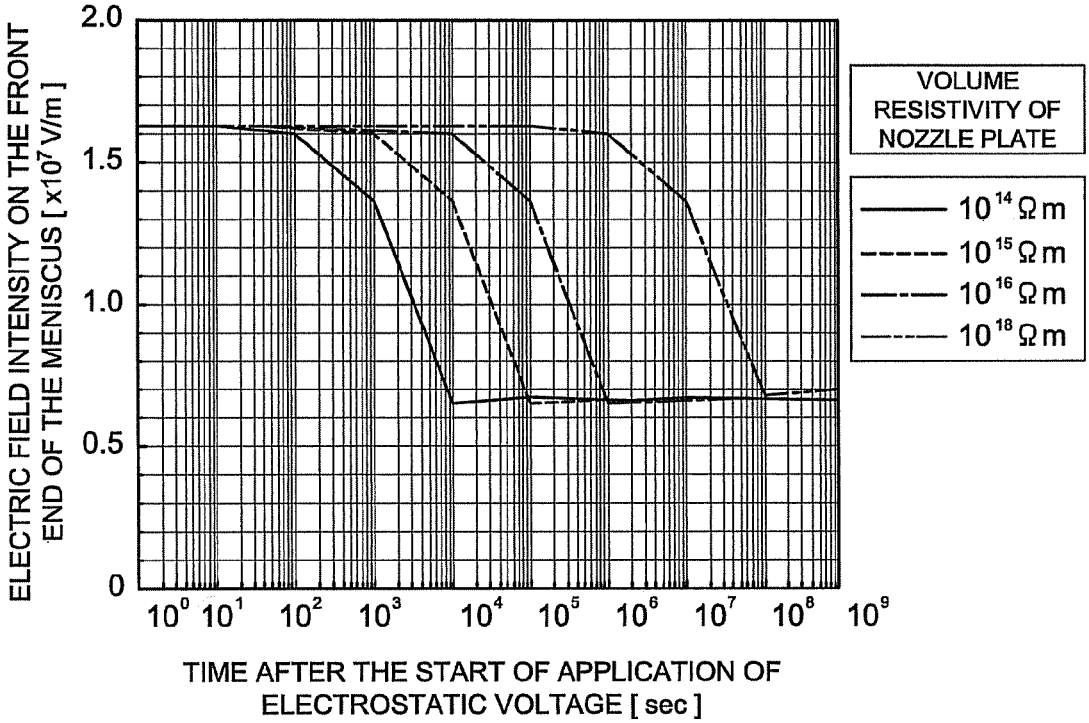
FIG. 5 is a diagram representing the relationship between the intensity of the electric field at the front end of the meniscus and the volume resistivity of the nozzle plate.

The same parameter as that in the aforementioned test conditions was inputted into the aforementioned software and the intensity of electric field on the front end of the meniscus was calculated. As shown in FIG. 5, it has been revealed, that the intensity of electric field heavily depends on the volume resistivity of the insulator used in the nozzle plate 12.

FIG. 5 shows the result of calculation to show that the intensity of electric field on the front end of the meniscus started to change only after the application of the electrostatic voltage was started, in case the volume resistivity of the insulator used for the nozzle plate 12 is $10^{14}$ Ωm through $10^{18}$ Ωm. In this calculation, the volume resistivity of air must be determined, and it is determined as $10^{20}$ Ωm. FIG. 5 shows that the intensity of electric field on the front end of the meniscus is substantially reduced by the ion polarization of the insulator used in the nozzle plate 12, 100 seconds after application of the electrostatic voltage has started, in case the volume resistivity is $10^{14}$ Ωm. The time from the start of application of the electrostatic voltage to the start of reduction in the intensity of electric field on the front end of the meniscus is determined by the ratio of the volume resistivity of air relative to the volume resistivity of the insulator used in the nozzle plate 12. Thus, as the volume resistivity of the insulator used in the nozzle plate 12 is greater, there is a greater delay in the start of decrease in the intensity of electric field on the front end of the meniscus. In other words, the time to realize the required intensity of electric field is prolonged, and this provides an advantage.

In Documents, the volume resistivity of the substance as an insulator or derivative is equal to or greater than $10^{10}$ Ωm in many cases. The volume resistivity of the polysilicate glass (e.g., PYREX (registered trade mark) glass) known as a typical insulator is $10^{14}$ Ωm.

The intensity of electric field on the front end of the meniscus depends on the thickness of the nozzle plate 12. Because, when the thickness of the nozzle plate 12 is increased, there is an increase in the distance between the ejection hole 14 of the nozzle 11 and charging electrode 17, and the equipotential lines in the nozzle plate is tend to form in the substantially perpendicular direction. This further facilitates concentration of electric field onto the front end of the meniscus.

Also by reducing the nozzle diameter, the meniscus diameter is also reduced thus the electric field is concentrated on the front end of the meniscus of reduced diameter, more intensively the electric field is concentrated. Thereby the intensity of electric field on the front end of the meniscus is to be increased.

Figure 6:
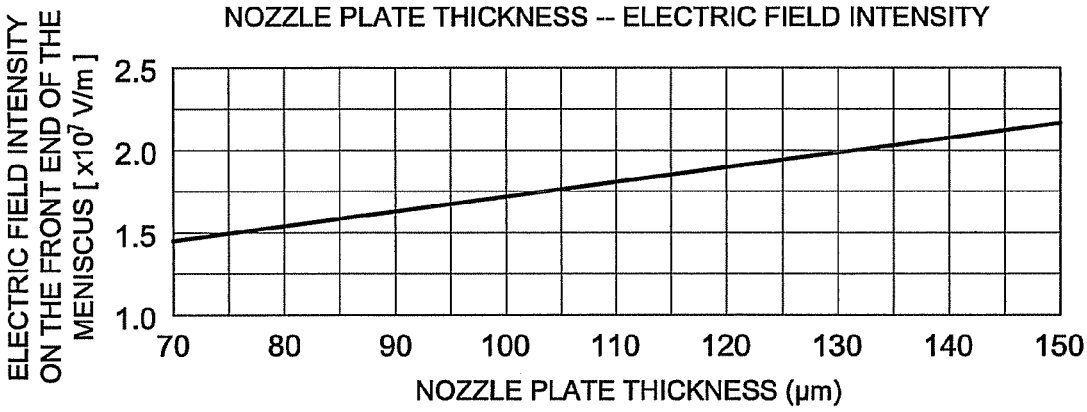
FIG. 6 is a diagram representing the relationship between the intensity of the electric field at the front end of the meniscus and the thickness of the nozzle plate.
Figure 7:
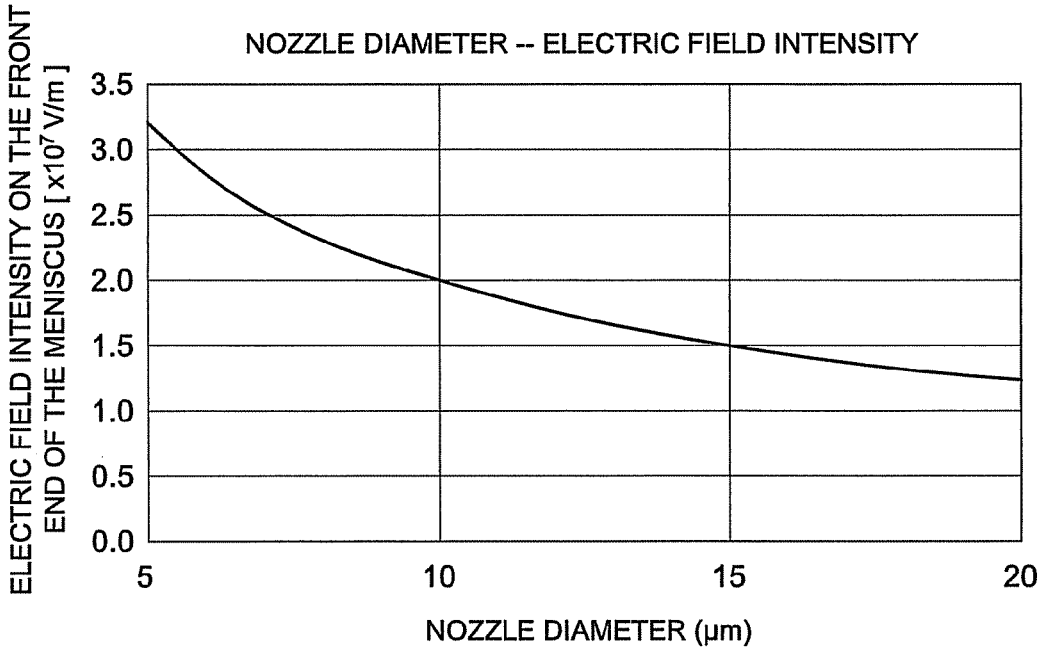
FIG. 7 is a chart representing the relationship between the intensity of the electric field at the front end of the meniscus and the nozzle diameter.

Meanwhile, Regarding the relationship between the thickness of the nozzle plate 12 and the intensity of electric field on the front end of the meniscus shown in FIG. 6, and the relationship between the nozzle diameter and the intensity of electric field on the front end of the meniscus shown in FIG. 7, the same simulation results were obtained not only in the case of the double-structure nozzle 11 made up of the small-diameter section 15 and large-diameter section 16 as in the present invention, but also in the case of a single structure, viz., the structure of a single tapered nozzle or cylindrical nozzle, or a multi-structured nozzle.

Figure 8:
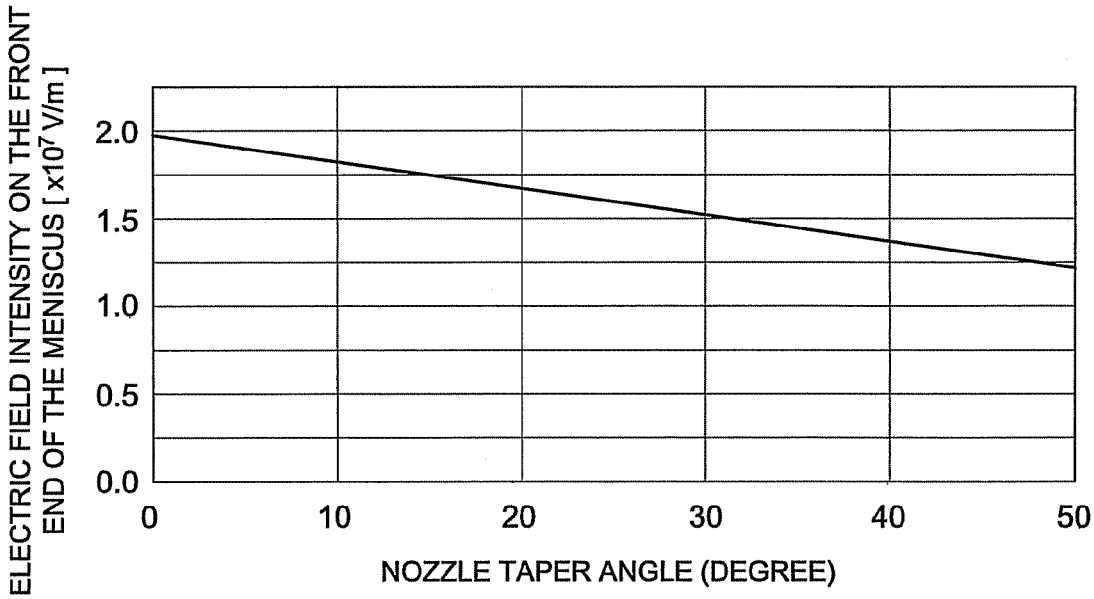
FIG. 8 is a diagram representing the relationship between the intensity of the electric field at the front end of the meniscus and the nozzle taper angle.

Further, in the tapered or cylindrical nozzle 11 of a single structure wherein there was no distinction between the small-diameter section 15 and large-diameter section 16, FIG. 8 shows a change in the intensity of electric field on the front end of the meniscus when the taper angle of the nozzle 11 was changed in the aforementioned simulation. According to the above results, it is apparent that the intensity of electric field on the front end of the meniscus depends on the taper angle of the nozzle 11. Thus, the taper angle of the nozzle 11 is preferably equal to or less than 30 degrees. Meanwhile, the taper angle refers to the angle formed by the inner surface of the nozzle 10 and the normal line of the ejection surface 12 of the nozzle plate 11. This corresponds to the fact that, when the taper angle is 0 degree, the nozzle 10 is cylindrical.

Also, the same parameter as that of the aforementioned test conditions was inputted into the same software, and the intensity of electric field on the front end of the meniscus was calculated. The result of this calculation shows that the intensity of electric field depended heavily on the volume resistivity of the insulator used in the nozzle plate 12, as shown in FIG. 5. In the Documents, the volume resistivity of the substance representing an insulator or dielectric material is equal to or greater than $10^{10}$ Ωm in many cases. The volume resistivity of the polysilicate glass (e.g., PYREX (registered trade mark) glass) known as a typical insulator is $10^{14}$ Ωm.

Also, in the insulator having such a volume resistivity, the liquid particle D is not ejected. This is because the intensity of electric field is reduced during or before judging the presence or absence of ejection, and the required intensity of electric field cannot be obtained. In case the volume resistivity of air was set at $10^{20}$ Ωm in accordance with the time required for ejection evaluation and the time required for observation, the intensity of the electric field conformed with the test result. After the intensity of electric field on the front end of the meniscus is once reduced, it is necessary to reduce ion polarization of the insulator used in the nozzle plate 12 and to return to the initial state.

As described above, to ensure stable ejection of the liquid droplet D from the nozzle 11, the intensity of electric field on the front end of the meniscus must be equal to or greater than $1.5\times10^{7}$ V/m. FIG. 5 shows that the volume resistivity of the nozzle plate 12 should be equal to or greater than $10^{15}$ Ωm for practical purposes so that the intensity of electric field on the front end of the meniscus can be maintained for at least 1000 seconds (15 minutes), and the same result is obtained in an experimental test.

The relationship between the volume resistivity of the nozzle plate 12 and the intensity of electric field on the front end of the meniscus is a peculiar relationship as shown in FIG. 5. This is because, if the volume resistivity of the nozzle plate 12 is low, equipotential lines in the nozzle plate are not arranged substantially perpendicular to the ejection surface 13 as shown in FIG. 4, even if the electrostatic voltage is applied, and this results in insufficient concentration of the electric field on the liquid L inside the nozzle and the meniscus of the liquid L.

Theoretically, even when the nozzle plate 12 has a volume resistivity of less than $10^{15}$ Ωm, the liquid particle D can be ejected from the nozzle 11 if the electrostatic voltage is increased excessively. However, a substrate K may be damaged due to the occurrence of a spark across the electrode. Accordingly, a nozzle plate having a volume resistivity of $10^{15}$ Ωm is preferably used.

As shown in FIG. 5, the characteristic dependency of the intensity of electric field of the front end of the meniscus upon the volume resistivity of the nozzle plate 12 is also revealed in the simulation conducted by changing the nozzle diameter variously. In all cases, it has been shown that the intensity of electric field on the front end of the meniscus is equal to or greater than $1.5\times10^{7}$ V/m when volume resistivity is equal to or greater than $10^{15}$ Ωm. Further, the thickness of the nozzle plate 12 in the aforementioned test conditions in the present embodiment is equal to the sum of the length of the small-diameter section 15 of the nozzle 11 and the length of the large-diameter section 16.

In the meantime, even when the nozzle plate 12 is manufactured using the insulator having a volume resistivity equal to or greater than $10^{15}$ Ωm, the liquid droplet D is not ejected from the nozzle 11 in some cases. As shown in the following Example 1, it has been revealed that the absorption coefficient of the liquid of the nozzle plate 12 is equal to or less than 0.6% in the test using the liquid containing a conductive solvent such as water as liquid L.

It is considered that when the nozzle plate 12 absorbs the conductive solvent from the liquid L, the electric conductivity of the nozzle plate 12 is increased because the molecule such as a water molecule as a conductive liquid is present in the nozzle plate 12 having inherent insulation property And this reduces the effective value of the volume resistivity especially on the portion in contact with liquid L, so that the intensity of electric field on the front end of the meniscus is reduced according to the relationship shown in FIG. 5, and concentration of the electric field required to eject the liquid L cannot be ensured.

On the other hand according to the following Example 1, it has been revealed that, in case liquid in which electrostatically chargeable particles are dispersed in the insulating solvent that does not include a conductive solvent is used as liquid L, the nozzle plate 12 ejects liquid L, irrespective of the absorption coefficient for the liquid, if the volume resistivity is equal to or greater than $10^{15}$ Ωm. This is because, even if the insulating solvent is absorbed in the nozzle plate 12, there is not much change in the electric conductivity of the nozzle plate 12 because the electric conductivity of the insulating solvent is low. Thus, effective volume resistivity is not reduced The electrostatically chargeable particle dispersed in the aforementioned insulating solvent is not absorbed in the nozzle plate 12, for example, even if it is a metallic particle having extremely large electric conductivity, and therefore, it does not increase the electric conductivity of the nozzle plate 12. The aforementioned insulating solvent means the solvent that is not ejected as a simple body by electrostatic suction force. Specifically, it is exemplified by xylylene, toluene and tetradecane. Further, the conductive solvent can be defined as a solvent having an electric conductivity of equal to or greater than $10^{-10}$ S/cm.

Figure 9:
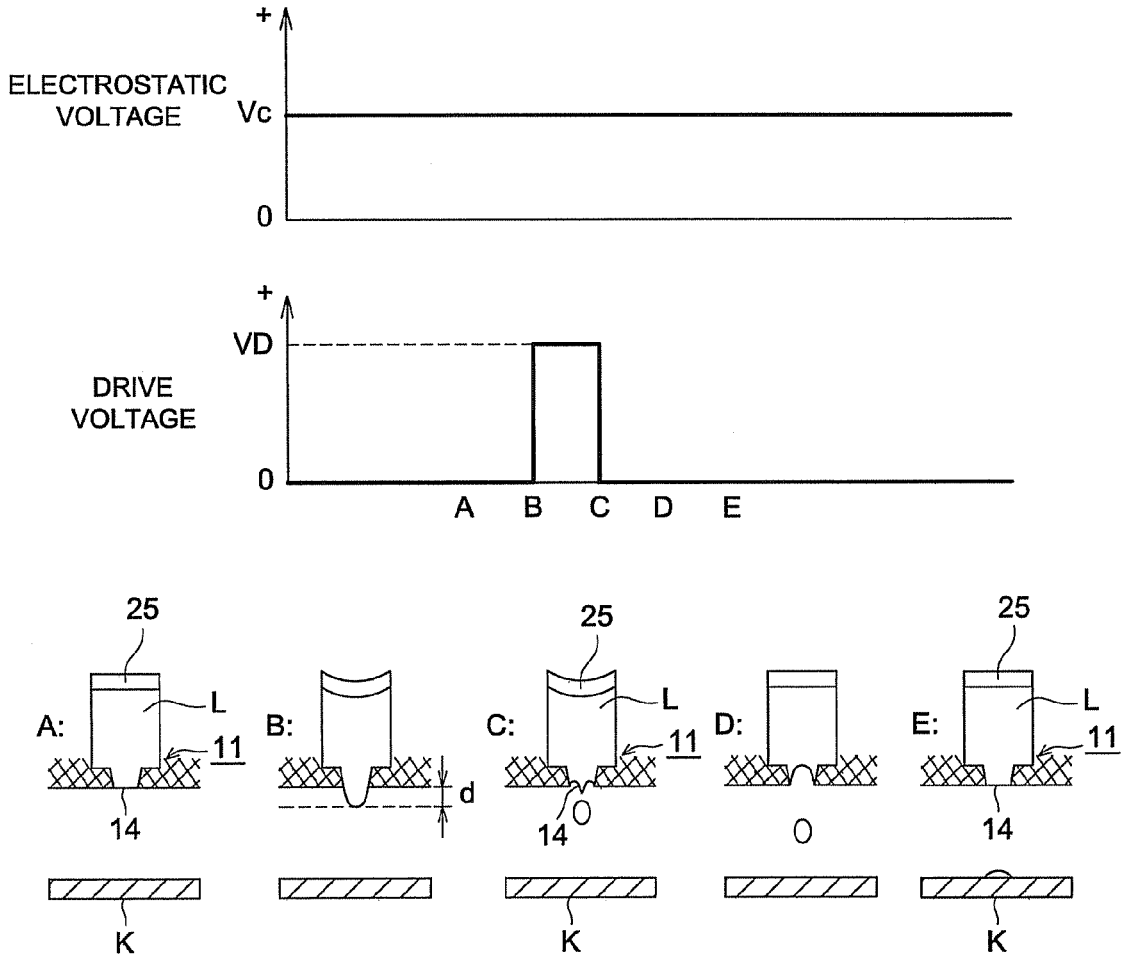
FIG. 9 is a diagram representing the drive control of the liquid ejection head when the height of the meniscus is formed to be 1.3 times the nozzle radius in the liquid ejection apparatus of the present invention.

The following describes the operations of the liquid ejection head 2 and liquid ejection apparatus 1 of the present embodiment:

FIG. 9 describes the drive control of the liquid ejection head in the liquid ejection apparatus in the present invention, wherein the meniscus height is 1.3 times the nozzle radius (=d). In this case, a predetermined electrostatic voltage $V_C$ applied to the charging electrode 17 from the electrostatic voltage power supply 19 is set at 1.5 kV, and the pulse-shaped drive voltage $V_D$ applied to the piezoelectric element 23 from the drive voltage power supply 24 is set to 20V.

The operation control device 25 of the liquid ejection apparatus 1, applies a predetermined electrostatic voltage $V_C$ to the charging electrode 17 from the electrostatic voltage power supply 19. Thereby a predetermined electrostatic voltage $V_C$ is always applied to each nozzle 11 of the liquid ejection head 2, and an electric field is produced between the liquid ejection head 2 and counter electrode 3.

Further, the operation control device 25 allows the pulse-shaped drive voltage $V_D$ to be applied to the piezoelectric element 23 from the drive voltage power supply 24 corresponding to the nozzle 11, for each nozzle 11 that should eject the liquid particle D. When such a drive voltage $V_D$ is applied, the piezoelectric element 23 is deformed to increase the pressure of the liquid L in the nozzle. In the ejection hole 14 of the nozzle 11, the meniscus starts to rise from the status A in the drawing, and the meniscus rises largely as shown in B.

As described above, this causes a high degree of concentration of the electric field on the front end of the meniscus, with the result that the intensity of electric field is increased to a great extent. Thus, heavy static electricity is applied to the meniscus from the electric field formed by the aforementioned electrostatic voltage $V_C$. The meniscus is torn away by an attracting force of this heavy static electricity and by the pressure given by the piezoelectric element 23, as shown in C of the drawing, and the liquid droplet D is produced without a mist or satellite being generated. As shown in D of the drawing, the liquid droplet D flies toward the substrate K, and the speed is increased by the electric field as shown in E of the drawing. It is then attracted toward the counter electrode to accurately land on the target destination of the substrate K supported by the counter electrode 3.

Figure 10:
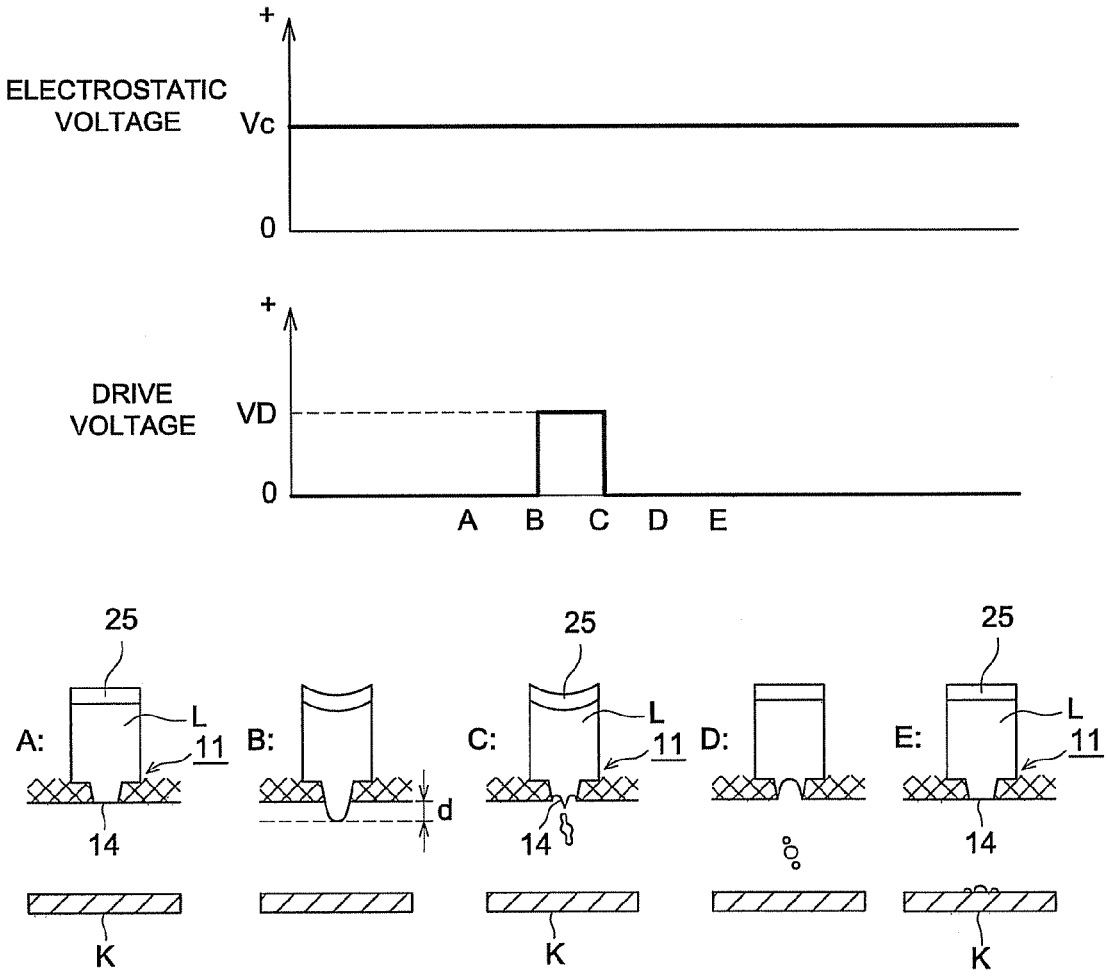
FIG. 10 is a diagram representing the drive control of the liquid ejection head when the height of the meniscus is formed to be ten times the nozzle radius in the liquid ejection apparatus of the present embodiment.

FIG. 10 shows the liquid ejection head drive control of the liquid ejection apparatus of the present embodiment wherein the meniscus height is 10 times the nozzle radius (=d). In this case, a predetermined electrostatic voltage $V_C$ applied to the charging electrode 17 from the electrostatic voltage power supply 19 is set at 2.0 kV, and the pulse-shaped drive voltage $V_D$ applied to the piezoelectric element 23 from the drive voltage power supply 24 is set to 15V. For the same portions as the case where the meniscus height is 1.3 times the nozzle radius, the descriptions are omitted.

When the meniscus is formed so that the height becomes ten times the nozzle radius, the liquid droplet is once ejected from the nozzle, as shown in C of the drawing, but it is fragmented into a plurality of liquid particle during the flight, as shown in D of the drawing. After that, as shown in E of the drawing, the liquid particle being fragmented is accelerated by electric field and is attracted toward the counter electrode and lands not only the target destination of the substrate K supported by the counter electrode 3, but also other points.

Figure 11:
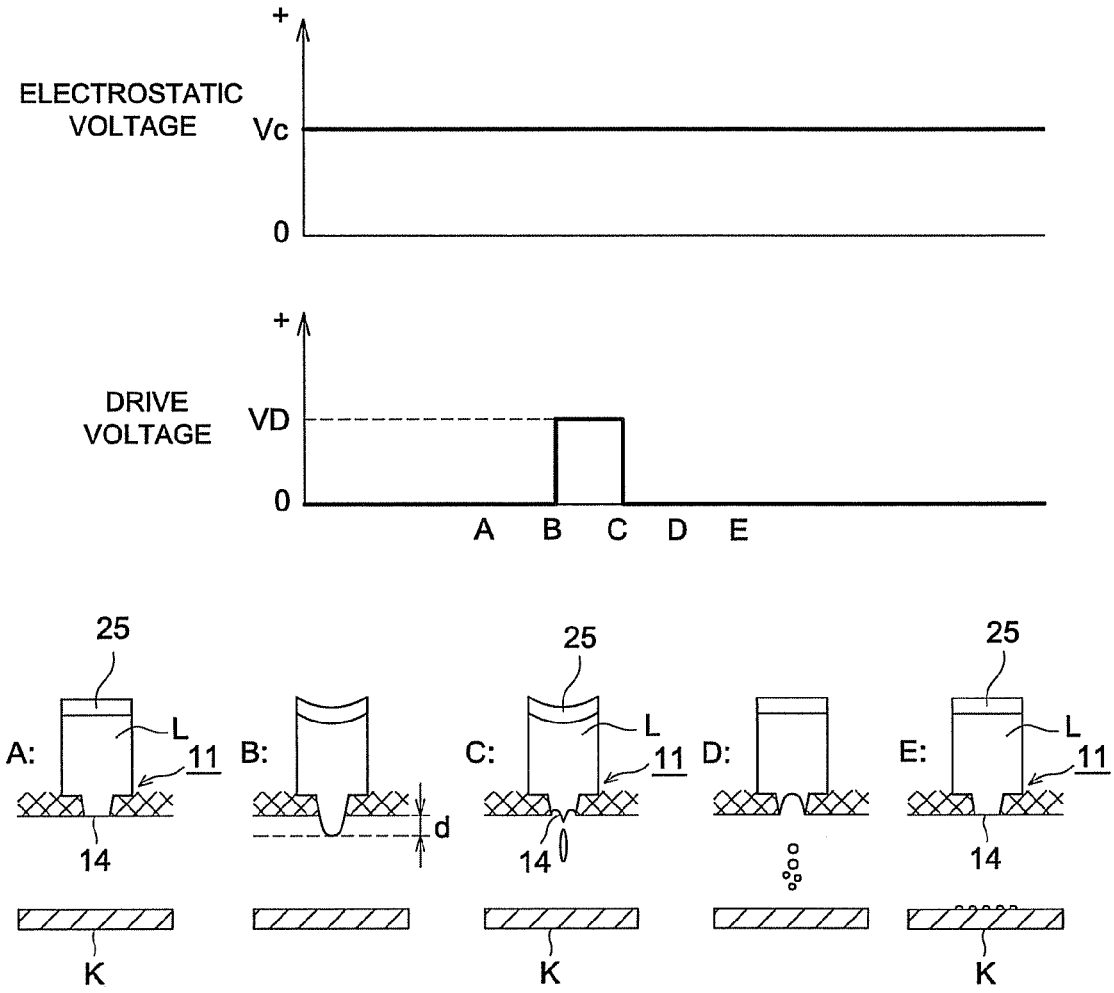
FIG. 11 is a diagram representing the drive control of the liquid ejection head when the height of the meniscus is formed to be 0.8 times the nozzle radius in the liquid ejection apparatus of the present embodiment.

FIG. 11 shows the liquid ejection head drive control in the liquid ejection apparatus of the present embodiment wherein the meniscus height is 0.8 times the nozzle radius (=d). In this case, a predetermined electrostatic voltage $V_C$ applied to the charging electrode 17 from the electrostatic voltage power supply 19 is set at 3.0 kV, and the pulse-shaped drive voltage $V_D$ applied to the piezoelectric element 23 from the drive voltage power supply 24 is set at 10V. The description for the same portion as the case where the meniscus height is 1.3 times the nozzle radius is omitted.

When the meniscus is formed so that the height becomes 0.8 times the nozzle radius, the liquid droplet is ejected as shown in C of the drawing after having been formed into the form of a tailor cone. Then it is fragmented into a plurality of liquid droplets while fling, as shown in D of the drawing. After that, as shown in E of the drawing, each liquid droplet does not always lands the target destination of the substrate K, and mist is produced.

Figure 12:
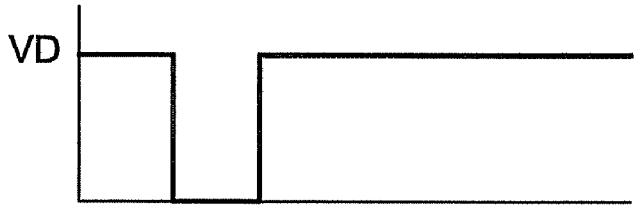
FIG. 12 is a diagram representing the variation of the drive voltage applied to the piezoelectric element.
Figure 12:
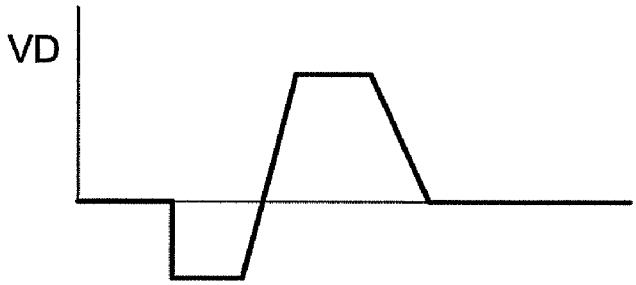
Figure 12:
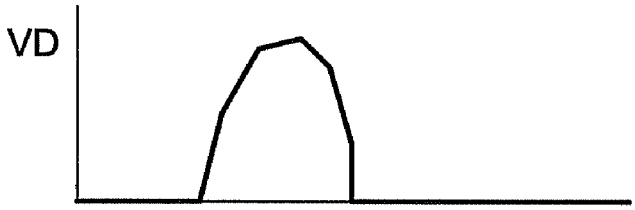

The drive voltage $V_D$ to be applied to the piezoelectric element 23 can be a pulse-shaped voltage as in the present embodiment. It is also possible to arrange, for example, such a configuration as to apply a so-called triangular voltage which exhibits a gradual increase followed by gradual decrease, a trapezoidal voltage where the voltage increases gradually, maintain a constant level for some time, and decreases gradually and a sine wave voltage. It is also possible to make such arrangements as shown in FIG. 12 (A) that voltage $V_D$ is applied to the piezoelectric element 23 at all times, then it is turned off once. Then the voltage $V_D$ is again applied, and liquid droplet D is ejected at the time of startup. It is also possible to apply various forms of drive voltage $V_D$ as shown in FIGS. 12(B) and (C). In this manner, the configuration can be determined as required.

As described above, the invention according to the present embodiment ensures stable ejection of liquid from the nozzle. The liquid ejected from the nozzle is formed in a liquid droplet so as to prevent a mist or satellite from occurring, whereby ejection stability is ensured.

When the meniscus height is equal to or greater than 1.3 times the nozzle radius, the liquid ejected from the nozzle is formed in a liquid particle. This eliminates the possibility of a mist or satellite being produced, and ensures stable ejection independently of the distance of the nozzle substrate.

Stable ejection of the minute liquid particle is ensured if the nozzle radius is equal to or less than 15 μm.

EXAMPLE

Example 1

The nozzle radius, meniscus height, and distance of the inkjet head nozzle surface and substrate K in the present embodiment were changed in several types to verify the state of the liquid ejected from the ejection hole 14 of the nozzle 11.

The liquid ejection head 2 was manufactured under the same conditions as those for the aforementioned test, and the distance between the inkjet head nozzle surface and the substrate K was set at 10 mm. The voltage $V_D$ applied to the piezoelectric element was adjusted while observing the rise of the meniscus.

Further, the ejection voltage $V_C$ was changed and adjusted to the level that permitted ejection, wherein the maximum voltage was set at 2 kV as upper limit. While the ejection voltage $V_C$ was changed successively, the state of ejection was observed. Table 1 shows the result under the best ejection conditions. The observation was made under the stroboscopic light using a CCD camera having a 5,000× lens The liquid ejected in the test includes 47% water, 22% ethylene glycol, 22% propylene glycol, 1% surface active agent and 3% dye (CI Acid Red 1). The nozzle used in the test was a flat nozzle made of a liquid-repellent finished polyethylene terephthalate (volume resistivity: $10^{15}$ Ωm) having a thickness of 125 μm sheet formed by laser-processing.

Table 1 shows the test result. The "Good" in the Table denotes the test result free from any ejection error, mist or satellite, and "Bad" indicates the test result wherein any one of the ejection error and mist or satellite occurred.

TABLE 1

| Meniscus extrusion height [μm] | Nozzle radius [μm] | Ratio of meniscus extrusion height relative to nozzle radius (times) | State of ejection | |
|---|---|---|---|---|
| 2.0 | 5.0 | 0.40 | Bad | Ejection error |
| 4.0 | 5.0 | 0.80 | Bad | Mist generated |
| 5.0 | 5.0 | 1.00 | Bad | Satellite generated |
| 6.0 | 5.0 | 1.20 | Bad | Satellite generated |
| 6.5 | 5.0 | 1.30 | Good | Good |
| 7.0 | 5.0 | 1.40 | Good | Good |
| 8.0 | 5.0 | 1.60 | Good | Good |
| 15.0 | 5.0 | 3.00 | Good | Good |
| 2.0 | 4.0 | 0.50 | Bad | Ejection error |
| 3.0 | 4.0 | 0.75 | Bad | Mist generated |
| 4.0 | 4.0 | 1.00 | Bad | Satellite generated |
| 5.0 | 4.0 | 1.25 | Bad | Satellite generated |
| 6.0 | 4.0 | 1.50 | Good | Good |
| 7.0 | 4.0 | 1.75 | Good | Good |
| 8.0 | 4.0 | 2.00 | Good | Good |
| 2.0 | 6.0 | 0.33 | Bad | Ejection error |
| 4.0 | 6.0 | 0.67 | Bad | Mist generated |
| 5.0 | 6.0 | 0.83 | Bad | Satellite generated |
| 6.0 | 6.0 | 1.00 | Bad | Satellite generated |

TABLE 1-continued

| Meniscus extrusion height [μm] | Nozzle radius [μm] | Ratio of meniscus extrusion height relative to nozzle radius (times) | State of ejection | |
|---|---|---|---|---|
| 7.0 | 6.0 | 1.17 | Bad | Satellite generated |
| 8.0 | 6.0 | 1.33 | Good | Good |
| 9.0 | 6.0 | 1.50 | Good | Good |
| 10.0 | 6.0 | 1.67 | Good | Good |
| 15.0 | 7.5 | 2.00 | Good | Good |
| 20.0 | 10.0 | 2.00 | Bad | Not ejected |

The test result shows that, when the nozzle diameter was above 15 μm, liquid was not ejected. This was evaluated as "Bad".

Also, when the meniscus height was less than 1.3 times the nozzle radius, an ejection error, mist and satellite occurred. This was also evaluated as "Bad".

When the meniscus height was equal to or greater than 1.3 times the nozzle radius, the liquid was ejected in a single main liquid droplet, and ejection was satisfactory without creating any mist or satellite. This was evaluated as "good".

What is claimed is:

1. A liquid ejection apparatus, comprising:

a liquid ejection head having;

a nozzle plate having a nozzle to eject liquid, a cavity to reserve liquid ejected form a ejection hole of the nozzle, a pressure generating device to form a meniscus of the liquid, and a ejecting voltage applying device to apply a ejection voltage to the liquid in the nozzle, an operation control device to control application of a drive voltage to drive the pressure generating device and application of the ejection voltage by the ejection voltage applying device; and a counter electrode opposite to the liquid ejection head;

wherein in the liquid ejection device in which the liquid is ejected by a static electric attraction force generated between the liquid in the nozzle to which a voltage is applied by the ejection voltage applying device and the counter electrode, and by a pressure generated in the nozzle, the pressure generating device to form the liquid meniscus forms the meniscus having a height of equal to or more than 1.3 times a radius of the nozzle on the ejection hole of the nozzle.

2. The liquid ejection apparatus of claim 1, wherein an inner diameter of the ejection hole of the nozzle is equal or less than 15 μm.

3. The liquid ejection apparatus of claim 2, wherein the nozzle is a flat nozzle which is not protruding from an ejection surface.

4. The liquid ejection apparatus of claim 1, wherein the nozzle is a flat nozzle which is not protruding from an ejection surface.

5. The liquid ejection apparatus of claims 4, wherein a volume resistivity of the nozzle plate is equal to or more than $10^{15}$ Ωm.

6. The liquid ejection apparatus of claims 5, wherein the liquid includes a conductive solvent and a absorption coefficient of the nozzle plate in respect to the liquid is equal or less than 0.3%.

* * * * *